US005622061A

United States Patent [19]

Sakata

[11] Patent Number: 5,622,061

[45] Date of Patent: Apr. 22, 1997

[54] PIERCED EARRING ASSEMBLY

[75] Inventor: Hideo Sakata, Omiya, Japan

[73] Assignee: Universe Yamaki Co. Ltd., Tokyo, Japan

[21] Appl. No.: 558,154

[22] Filed: Nov. 15, 1995

[30] Foreign Application Priority Data

Feb. 6, 1995 [JP] Japan ..... 7-017652

[51] Int. Cl.[6] ..... A44C 7/00

[52] U.S. Cl. ..... 63/12; 63/13; 24/705

[58] Field of Search ..... 606/188; 63/12, 63/13; 24/705

[56] References Cited

U.S. PATENT DOCUMENTS 5,018,365 5/1991 Luceno ..... 24/705

5,437,166 8/1995 Gardner ..... 63/12

*Primary Examiner*—Michael Buiz
*Assistant Examiner*—Mark S. Leonardo
*Attorney, Agent, or Firm*—Rabin, Champagne & Lynt, P.C.

[57] ABSTRACT

The earring assembly is manufactured at low cost, which enables conventional pierced earrings to be reused, is diversified in ornamental effect and has its user be completely free from a so-called metal allergy. In the assembly: a post 10 is fabricated from titanium, titanium alloys, or ceramics; an insertion hole 50 is formed in a front-end portion 11 of the post 10, the hole 50 extending in a direction of its longitudinal axis Z; an insertion axle 60 corresponding to the insertion hole 50 is formed in a holder 30; and, the insertion axle 60 of the holder 30 is inserted into the hole 50 of the post 10 and fixed thereto with the use of an adhesive, whereby the holder 30 is integrated into the post 10.

9 Claims, 6 Drawing Sheets

PIERCED EARRING ASSEMBLY

BACKGROUND OF THE INVENTION

1. Field of the Invention

The present invention relates to a low-cost pierced earring assembly, which may reuse conventional pierced earrings, is diversified in ornamental effect, and allows its user to be completely free from to the effect of a so-called metal allergy.

2. Description of the Prior Art

Shown in FIGS. 7 to 10 are conventional pierced earrings.

Of these conventional earrings, one shown in FIG. 7 is essentially constructed of a post 10, a stopper 20, a holder 30 and an ornament piece 40.

The post 10 has its essential portion constructed of a through-shaft portion 12 which axially extends in a direction Z. Mounted on a front-end portion 11 of the post 10 through the holder 30 is the ornament piece 40. The stopper 20 is detachably mounted on an annular groove 14 formed in a rear-end portion 13 of the post 10. The stopper 20 is a so-called catcher which is of a spring type provided with an insertion portion and a spring portion.

The holder 30 is constructed of the following: a plate-type holder body 31P which is integrally formed with the front-end portion 11 of the post 10, or brazed or welded to the front-end portion 11; and, an auxiliary member constructed of a plurality of rings 32, 33.

The ornament piece 40 is constructed of, for example, a diamond 43D which is fixedly mounted on a mount 41 by staking a plurality of nail portions 44 of the mount 41 provided with a mounting ring 42. Incidentally, as shown in FIG. 8, in some conventional earrings, the mount 41 is directly fixed to the post 10 (or 11). In this case, the mount 41 also serves as the holder (30).

Consequently, in use, the post 10 has its rear-end portion 13 inserted into a through-hole 101 of an earlobe 100 of the user, then has its though-shaft portion 12 inserted into the through-hole 101, and thereafter the stopper 20 is mounted on the post 10 from the rear-end portion 13 thereof and forcibly moved forward so as to fit into the annular groove 14, whereby the pierced earring (10, 20, 30, 40) is mounted on the earlobe 100 in an easy manner.

In the case of another conventional pierced earring as shown in FIG. 9, the holder 30 is constructed of a spherical holder body 31B and an auxiliary member which comprises, in combination, five rings 32, 33, 34, 35, 36. The ornament piece 40 used in the holder 30 is a pearl 43P fixedly mounted on the mounting ring 42. In the case of a further conventional pierced earring as shown in FIG. 10, the holder 30 is constructed of a hook member 31F which is integrally formed with an auxiliary plate portion 32P. In this holder 30, the ornament piece 40 is constructed of a plurality of gold pellets 43G.

As described above, both the post 10 and the stopper 20 are common to the conventional pierced earrings which are classified into, for example, more than 50,000 types based on variations of their holder 30 and ornament piece 40, which vary in types and shapes, the holder 30 varying in structure, color and material. Incidentally, the holder 30 functions to firmly hold the noble and expensive ornament piece 40 on the post 10, and often serves as an additional ornament piece (40).

In other words, in order to have the holder 30 properly function, as shown in FIGS. 7, 9 and 10, the holder body 31P, 31B, 31F is connected with the auxiliary member (32, 33, . . . ) by the use of brazing, welding, staking and like processes. Further, the holder body 31P, (41), 31B, 31F shown in FIGS. 7 to 10 are fixedly mounted on the post 10 (11) by the use of brazing, welding and like processes, or integrally formed with the post 10(11) by the use of machining and like processes.

In order to provide a sufficient ornamental effect to both the holder body 31P, 31B, 31F and the auxiliary member (32, 33 . . . ), such body and member are made of gold, silver and like noble metals, or made of copper alloys and stainless steel, both having been palladium-plated, nickel-plated, or chromium-plated. In addition, the post 10 is manufactured by the use of suitable processes such as casting, forging, rolling, machining and the like, the processes being selected in view of manufacturing cost.

Of such various types of conventional pierced earrings, the user selects a preferred one in view of shapes, colors, materials, types of the ornament pieces 40, and the prices thereof. Further, in comparison with the user of earrings of spring types and screw-types, the user of the pierced earrings is free from a fear of dropping off and losing the ornament pieces 40 of the tarrings, which enables the user of the pierced earrings to purchase another expensive one and to enjoy its ornamental effect.

PROBLEMS TO BE SOLVED BY THE INVENTION

In use, however, the pierced earring requires its insertion into the user's earlobe (100), which often causes a so-called metal allergy. Under such circumstances, it is internationally recommended that the percentage of nickel contained in the pierced earring should be less than 1/100 by weight.

In this connection, in case public health takes priority over all, an inert material such as ceramics, titanium and like materials, which do not cause metal allergic reactions may be used to produce the pierced earrings. However, these inert materials are extremely poor in workability, and, therefore should be machined to produce the pierced earrings. As a result, the pierced earring thus machined is monotonous in shape as shown in FIG. 11, in which a spherical ornament portion 15 is integrally formed with the front-end portion 11 of the post 10. Since the ornament portion 15 substantially serves as the ornament piece 40 in the pierced earring of FIG. 11, such an earring is poor in ornamental effect. Consequently, after completion of machining, in order to prevent the earring from being monotonous, when the holder 30 provided with an ornament piece 40 excellent in ornamental effect, as shown in FIGS. 7 to 10, is fixedly mounted on the ornament portion 15 by the use of additional processes, for example such as brazing, the pierced earring thus produced suffers from requirement that additional processes must be applied due to their difficulty, thereby increasing manufacturing cost. Further, there is a fear that the pierced earring thus produced may be poor in holding power.

In still another conventional pierced earring as shown in FIG. 12, a solid holder portion 16 provided with a holding hole 18 is formed in a front-end portion of the post 10, and a jewel 40S is mounted in the holding hole 18 and fixed thereto by staking a plurality of engaging segments 17 of the holder portion 16. This one is preferable in ornamental effect to that of FIG. 11. However, even in this one, since the jewel 40S is restricted to be small in size one, it is difficult to give a variety of ornamental effect to the pierced earring. Further, as for shape, since the jewel 40S is fixed on the longitudinal axis (Z) of the post 10, it is also difficult to give variety to the pierced earring. As described above, it is necessary to improve the pierced earring both in ornamental effect and for the prevention of the metal allergic reaction. Consequently, when the above requirements are satisfied, it is possible for the pierced earring to be widely used.

Further, there is an acute demand among users to wear a various types of the ornament pieces 40 which enables the users to express their individualities. There is also an economical demand. In other words, it is usual that some users who have their health, to suddenly suffer from a metal allergic reaction when subjected to variations in seasons or physical conditions. In this case, although it is sure that users are free from a metal allergic reaction when they wear pierced earrings made of inert materials, it is difficult for users to discard their ornamental collections, for example, more than 1000 pieces of the conventional pierced earrings not made of inert materials, which would cause a large economical loss. Particularly, in case the holder 30 of the conventional pierced earring is made of gold and its ornament piece 40 is of diamond, the economic loss thereof becomes considerable. Since there is a possibility of amend to the user's metal allergy, it is hard to discard one's collection of the conventional earrings.

SUMMARY OF THE INVENTION

It is an object of the present invention to provide a low-cost pierced earring assembly, which may reuse conventional pierced earrings, may be diversified in ornamental effect and has its user be completely free from the effects of a metal allergy.

MEANS FOR SOLVING THE PROBLEMS

The present invention was made in view of the fact that: it is necessary to machine an inert material which does not cause a metal allergic reaction i.e., such machining may realize a possible minimum cost in manufacturing; when a user's earlobe (100) does not directly contact with the pierced earring, there is no fear of the metal allergy; and, it is possible to use a conventional holder construction in a portion of the pierced earring, the portion not directly contacting the user's earlobe (100), the holder construction being capable of completely preventing an ornament piece from dropping out of its holder. Namely, in the pierced earring assembly of the present invention: an insertion hole is formed in a front-end portion of a post by the use of the same machining operation of the post; an insertion axle corresponding to the insertion hole is formed in the holder; and, the insertion axle of the holder is inserted into the insertion hole of the post and fixed thereto by the use of an adhesive, whereby the pierced earring assembly of the present invention has a novel construction.

More particularly, according to a first aspect of the present invention, the above object of the present invention is accomplished by providing in a pierced earring assembly, a post and a stopper, the post having its front-end portion engaged with an ornament piece through a holder and having its rear-end portion provided with an annular groove, the stopper being detachably mounted in the annular groove, the improvement wherein:

the post is made of titanium, titanium alloys, or ceramics, and provided with an insertion hole in its front-end portion so as to extend in a direction parallel to its longitudinal axis;

an insertion axle corresponding to the insertion hole of the post is formed in the holder; and the insertion axle of the holder is inserted into the insertion hole of the post and fixed thereto by the use of an adhesive, whereby the holder is integrated into the post.

In the present invention having the above construction, the insertion hole is formed in the front-end portion of the post by the use of the same machining operation of the post which is made of titanium alloy. Consequently, it is possible to form the insertion hole substantially without increasing the machining cost of the post. After completion of such machining, the adhesive is applied to both or either one of the insertion axle of the holder and the insertion hole of the post, the holder carrying the ornament piece. Then, the insertion axle of the holder is inserted into the insertion hole of the post and kept stationary in a predetermined environment for a predetermined period of time to cure the adhesive, whereby the holder is fixedly mounted on the post. Therefore, it is possible to firmly hold the holder and the carried ornament piece in the post in an easy manner, the holder being made of the titanium alloy which is an inert material.

As a result, the pierced earring assembly of the present invention is capable of giving variety to its ornament piece, and also capable of completely releasing its user from a fear of the effects of metal allergy. Furthermore, in the pierced earring assembly of the present invention, since the holder can be made of any material, it is possible to reuse a conventional holder made of gold, nickel, copper alloys and the like together with a conventional ornament piece, which makes it possible to realize a considerable cost reduction.

According to a second aspect of the present invention, the above object of the present invention is accomplished by providing a pierced earring assembly as set forth in the first aspect of the present invention, wherein:

a solid holder portion, which is larger in diameter than the post, is formed in the front-end portion of the post; and the insertion hole is provided in the solid holder portion of the post.

In the present invention having the above construction, since the insertion hole is provided in the solid holder portion formed in the front-end portion of the post, it is possible to enjoy the same effect as that of the first aspect of the present invention. Further, it is possible to optimize the size or diameter of the insertion hole with reference to the size or diameter of the corresponding insertion axle being inserted into the insertion hole. In other words, the pierced earring assembly of the present invention is considerably improved in adaptability.

According to a third aspect of the present invention, the above object of the present invention is accomplished by providing the pierced earring assembly in the second aspect of the present invention, wherein:

in an end surface of the solid holder portion of the post, there is formed an adhesive-holding concave portion which communicates with the insertion hole and is capable of holding the adhesive therein.

In the present invention having the above construction, since the adhesive-holding concave portion is provided in the end surface of the solid holder portion, it is possible to realize the same effect as that of the second aspect of the present invention. Further, the holder is improved in holding power with respect to the adhesive. In addition to this, it is also possible for the holder to prevent the adhesive having been applied to both the insertion hole and the insertion axle from leaking out of the concave portion thereof, which improves the pierced earring assembly of the present invention in appearance.

According to a fourth aspect of the present invention, the above object of the present invention is accomplished by providing the pierced earring assembly in the second or the third aspect of the present invention, wherein:

the end surface of the solid holder portion of the post is formed into a convex shape corresponding to the holder assuming a spherical shape.

In the present invention having the above construction, since the end surface of the solid holder portion corresponding to the spherical holder assumes a concave shape, it is possible to enjoy the same effect as that of the second or the third aspect of the present invention. Further, it is possible to firmly bond the holder to the post. Consequently, the holder body is considerably improved in adaptability in shape.

In summary, in the first aspect of the present invention: the post is made of titanium, titanium alloys, or ceramics; the insertion hole is provided in the front-end portion of the post to extend in a direction parallel to the longitudinal axis of the post; the insertion axle, which corresponds to the insertion hole of the post, is provided in the holder; and, the insertion axle is inserted into the insertion hole and fixed thereto with the use of the adhesive, whereby the holder is integrated with the post. Consequently, it is possible for the present invention to: reuse conventional structures of the holder and ornament pieces; diversify its pierced earring assembly in ornamental effect; completely release its user from a fear of the effect of metal allergy; and provide a low-cost pierced earring assembly.

In the second aspect of the present invention: the same effect as that of the first aspect of the present invention is realized; and, the size or diameter of the insertion hole of the post is optimized with respect to the insertion axle of the holder being inserted into the insertion hole, which makes it possible to considerably improve the pierced earring assembly of the present invention in adaptability.

In the third aspect of the present invention: the same effect as that of the second aspect of the present invention is realized; and, the holder is improved in holding power and may prevent the adhesive, having been applied to both the insertion hole and the insertion axle, from leaking out of the holder, which improves the earring assembly of the present invention in appearance.

In the fourth aspect of the present invention: the same effect as that of the second or the third aspect of the present invention is realized; and, the spherical holder may be firmly bonded to the post with the use of the adhesive, which further improves the holder body in adaptability in shape.

DESCRIPTION OF THE PREFERRED EMBODIMENTS

Figure 1:
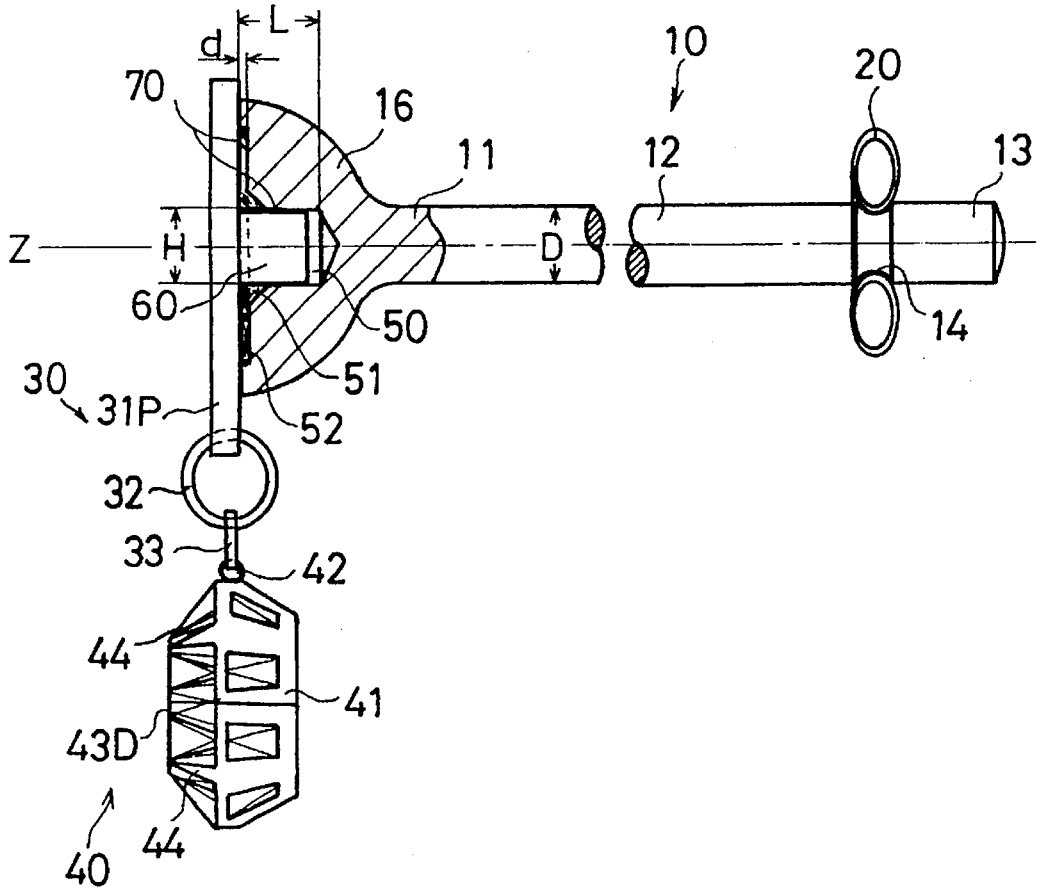
FIG. 1 is a partially-broken side view of a first embodiment of the present invention.

Hereinbelow, the present invention will be described in detail with reference to the accompanying drawings.

FIRST EMBODIMENT OF THE INVENTION

In the drawings: the reference numeral 10 denotes a post; 11 a front-end portion of the post; 12 a through-shaft portion of the post; 13 a rear-end portion of the post; 14 an annular groove of the post; 15 an ornament portion; 16 a solid holder portion; 17 an engaging segment; 18 a holding hole; 20 a stopper or catcher; 80 a holder; 31P a plate-type holder body; 31B a spherical holder body; 31F a hook-type holder body; 40 an ornament piece; 41 a mount; 42 a mounting ring; 43D a diamond; 43P a pearl; 48S a jewel; 44 a nail portion; 50 an insertion hole; 51 an oblique hole; 52 an adhesive-holding concave portion; 60 an insertion axle; and, 70 an adhesive.

Figure 2:
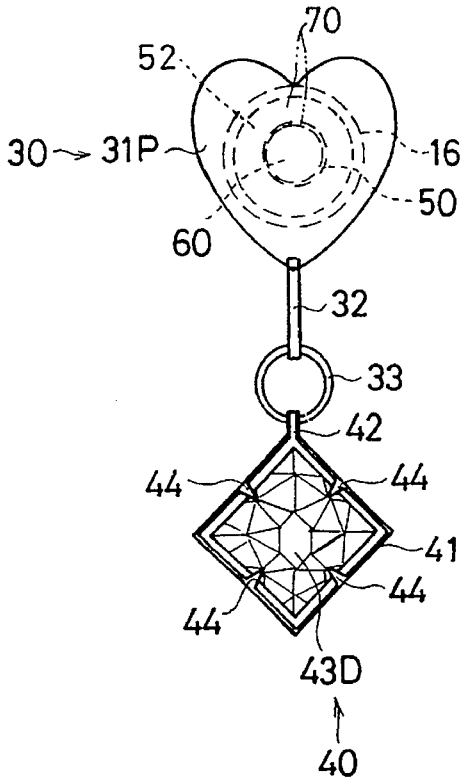
FIG. 2 is a front view of the first embodiment of the present invention.
Figure 3:
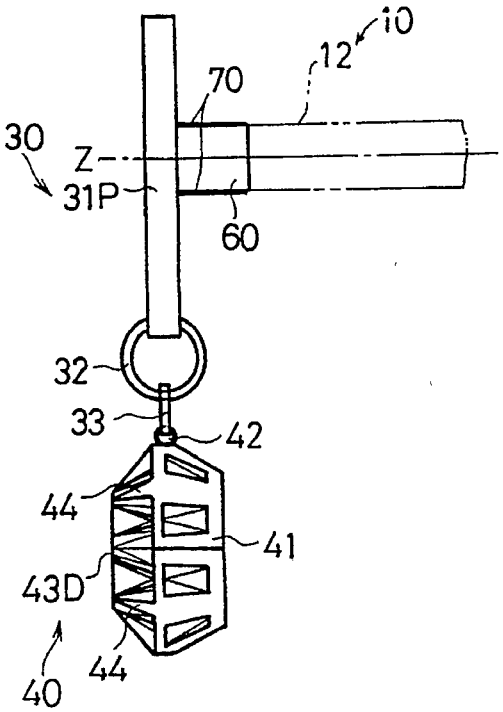
FIG. 3 is a side view of a plate-type holder of a conventional pierced earring, the holder being subjected to machining or like processes to provide the insertion axle of the present invention so as to reuse the holder.

In a first embodiment of a pierced earring assembly of the present invention shown in FIGS. 1 to 3, the post 10 is made of titanium alloy. The insertion hole 50 is formed in the front-end portion 11 of the post 10 to extend in a direction parallel to a longitudinal axis Z of the post 10. The holder 30 is provided with the insertion axle 60. In assembly operations, the insertion axle 60 of the holder 30 is inserted into the insertion hole 50 of the post 10 and firmly bonded thereto with the use of an adhesive 70, so that the holder 30 is integrated with the post 10.

As shown in FIG. 1, the post 10 is provided with the front-end portion 11, rear-end portion 13 and the through-shaft portion 12 in which the annular groove 14 is formed. The post 10 is produced by machining a round bar of 6A14V (6 aluminum, 4 vanadium) titanium alloy which is a most inert one of existing materials with respect to the human body, in which machining the round bar is turned on its axis Z. A diameter D of the post 10 is 0.8 mm. The post 10 is provided with a large-diameter solid holder portion 16 in its front-end portion 11. The solid holder portion 16 is larger in diameter than the post 10 to facilitate formation of the insertion hole 50 therein, the insertion hole 50 being formed for the holder body 31P in consideration of the shape of the holder 30. This solid holder portion 16 is machined together with the post 10. Incidentally, the stopper or catcher 20 provided with an insertion portion and a spring portion is made of titanium to facilitate its bending operation in use. On the other hand, the insertion hole 50 is formed by machining with a cutting tool or by drilling with a drill after completion of the machining of the solid holder portion 16. In this first embodiment of the present invention, the insertion hole 50 has a diameter H of 0.9 mm and a depth L of 1 mm. Formed in a left-end surface of the solid holder portion 16 as viewed in FIG. 1 is the adhesive-holding concave portion 52 having a sufficient depth for holding the adhesive therein. More particularly, the adhesive-holding concave portion 52 assumes a circular shape and communicates with the insertion hole 50 through the oblique hole 51, so that the solid holder portion 16 of the post 10 is improved in its holding power for holding the plate-type holder body 31P therein. The concave portion 52 of the post 10 has a depth "d" of 0.1 mm.

Figure 7:
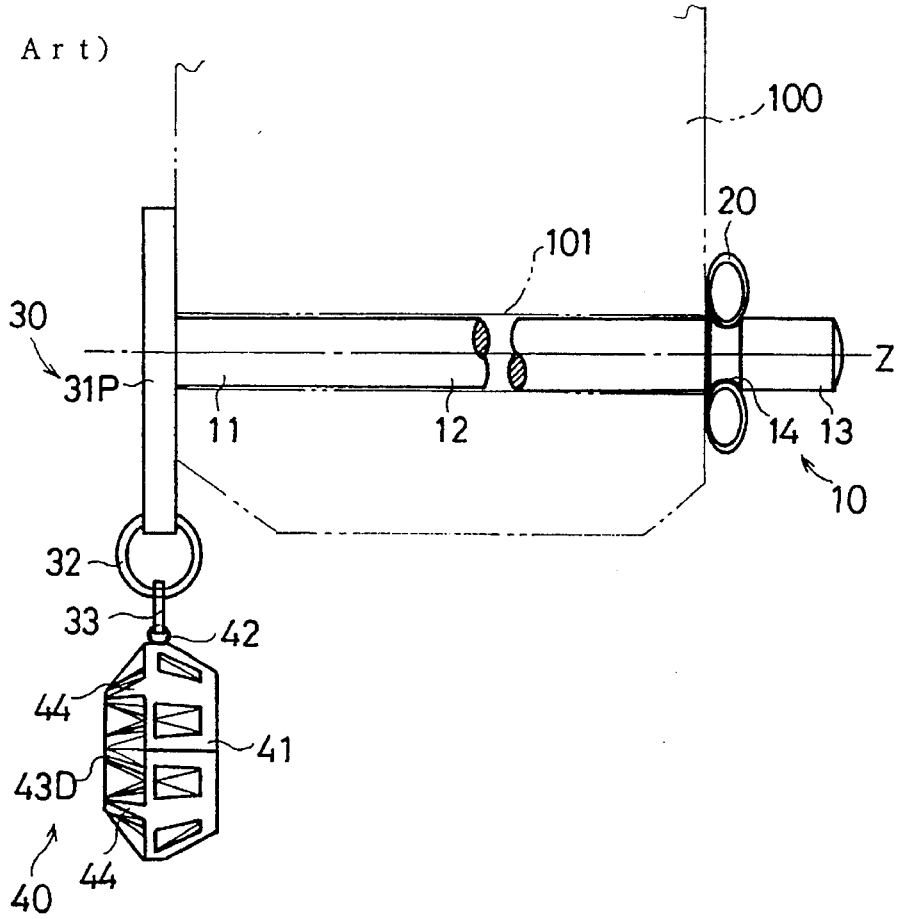
Fig. 7 (Prior Art)
FIG. 7 is a side view of a first conventional pierced earring.
Figure 8:
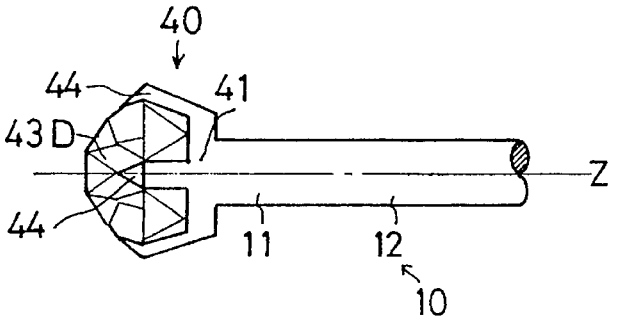
Fig. 8 (Prior Art)
FIG. 8 is a side view of a second conventional pierced earring.

The holder 30 (31P, 32, 33) is made of gold, in which the holder body 31P assumes a heart-shaped configuration, as shown in FIG. 2. On the other hand, the ornament piece 40 is constructed of the mount 41 and the diamond 43D. The mount 41 is provided with the mounting ring 42 and a plurality of the nail portions 44. These nail portions 44 are so staked as to fix the diamond 43D to the mount 41. More particularly, both the holder 30 and the ornament piece 40 of the first embodiment of the present invention are obtained from the conventional pierced earring shown in FIG. 7. In other words, these components 30, 40 are produced by cutting off the post 10 of the conventional pierced earring of FIG. 7 in a manner as shown in FIG. 3. It is also possible to use new- or separately-prepared ones of these components 30, 40 without reusing the conventional pierced earring.

Further, the insertion axle 60 of the holder 31 (31P) is produced by reusing a part 12 (11) of the thus cut-off post 10 of the conventional pierced earring. Consequently, the thus produced insertion axle 60 has the same diameter as that of the through-shaft portion 12 of the conventional pierced earring of FIG. 7, i.e., has a diameter of 0.8 mm. Further, since the insertion axle 60 is a reused one of the part (12) of the conventional product, the axle 60 is of a nickel-plated copper alloy as is in the holder 30 (31P).

In assembly operations, the adhesive 70 is applied to a peripheral surface of the insertion axle 60 of FIG. 3. If necessary, the adhesive 70 is also applied to the adhesive-holding concave portion 52, the adhesive 70 being shown in bold black lines in FIG. 1 for convenience of illustration. Then, the insertion axle 60 having the diameter of 0.8 mm is inserted into the insertion hole 50 having the diameter H of 0.9 mm and subjected to natural seasoning, which enables the holder 30 and the post 10 to be firmly bonded together so as to form an integral entity, the holder 30 being provided with the ornament piece 40.

Consequently, according to the present invention, it is possible to produce a low-cost pierced earring assembly in an easy manner, in which assembly the various conventional types of the holders 30 and the ornament pieces 40 are reused together with the post 10 which is free from a fear of the metal allergy. In other words, it is possible to improve the conventional pierced earring of FIG. 7 by using its holder 30 and ornament piece 40 and together with the new- or separately-prepared post 10 which is made of the inert material free from a fear of the metal allergy. The pierced earring assembly of the present invention can naturally use new- or separately-prepared ones of the holder 30 and the ornament piece 40, and is excellent for the prevention of the metal allergy.

Further, in this first embodiment of the present invention: the post 10 is made of titanium alloy; the insertion hole 50 is provided in the front-end portion 11 of the post 10 to extend in a direction parallel to the longitudinal axis Z of the post 10; the insertion axle 60 corresponding to the insertion hole 50 is provided in the holder 30; and, the insertion axle 60 of the holder 30 is inserted into the insertion hole 50 of the post 10 and fixed thereto with the use of the adhesive 70, whereby the post 10 and the holder 30 form an integral entity. Consequently, the pierced earring assembly of the present invention is capable of reusing the conventional product (shown the FIG. 7), varying in ornamental effect, completely preventing the effects of metal allergy, and, enabling the user to save money with its low price.

Still further, in the present invention, since the solid holder portion 16 is formed in the front-end portion 11 of the post 10, in which holder portion 16 the insertion hole 50 is formed by machining, it is possible to optimize the diameter (H) of the insertion hole 50 (in which the insertion axle 60 is inserted) with reference to the insertion axle 60, which considerably improves the pierced earring assembly of the present invention in adaptability of use.

In addition, in the present invention, since the adhesive-holding concave portion 52 is provided in the end surface of the solid holder portion 16, it is possible to increase the holding power of the plate-type holder 31P. Further, since the concave portion 52 communicates with the insertion hole 50 in the post 10, it is also possible to prevent the adhesive 70, having been applied to both the insertion hole 50 and the insertion axle 60, from dropping out of the post 10, which improves the pierced earring assembly of the present invention in appearance.

In the pierced earring assembly of the present invention, since both the holder 30 and the ornament piece 40 may be reused-ones of a conventional product (shown in FIG. 7) together with another reused-one, i.e., insertion axle 60 which is the part 11 (12) of the conventional post 10, it is possible for the user to enjoy, at low cost, the wide variety of a conventional-product collection without fear of the metal allergy according to the improvement accomplished by the present invention.

SECOND EMBODIMENT OF THE INVENTION

Figure 4:
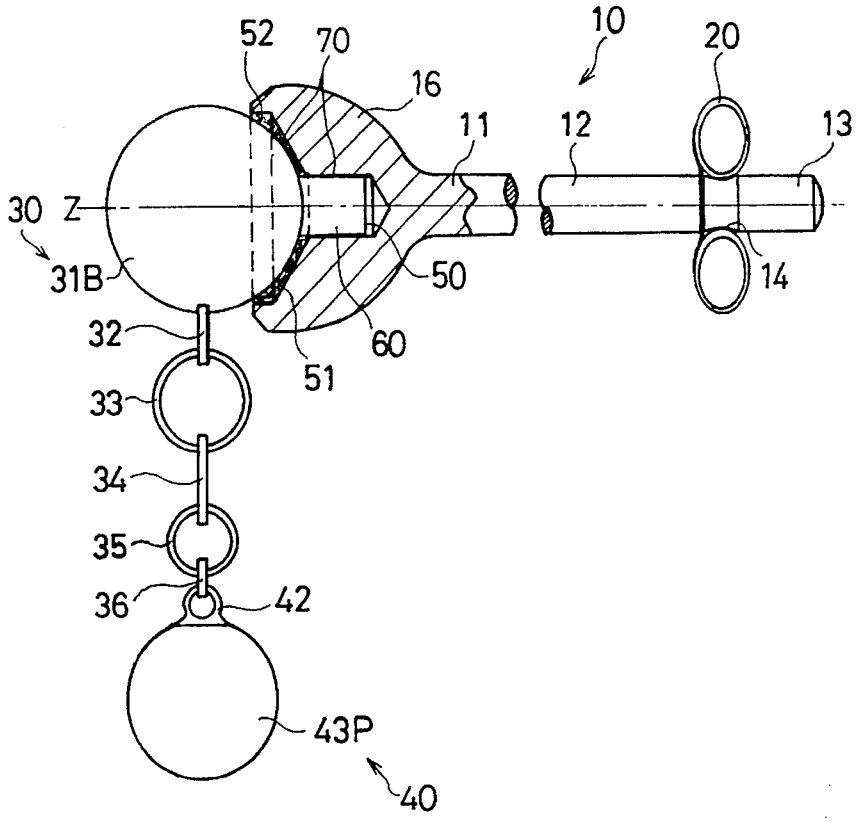
FIG. 4 is a partially-broken side view of a second embodiment of the present invention.
Figure 5:
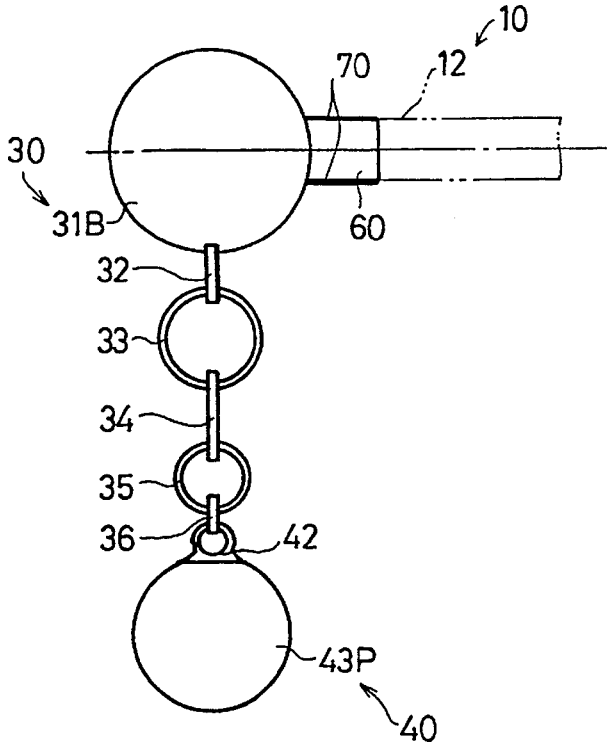
FIG. 5 is a side view of a spherical holder of another conventional pierced earring, the holder being subjected to machining or like processes to provide the insertion axle of the present invention so as to reuse the holder.
Figure 9:
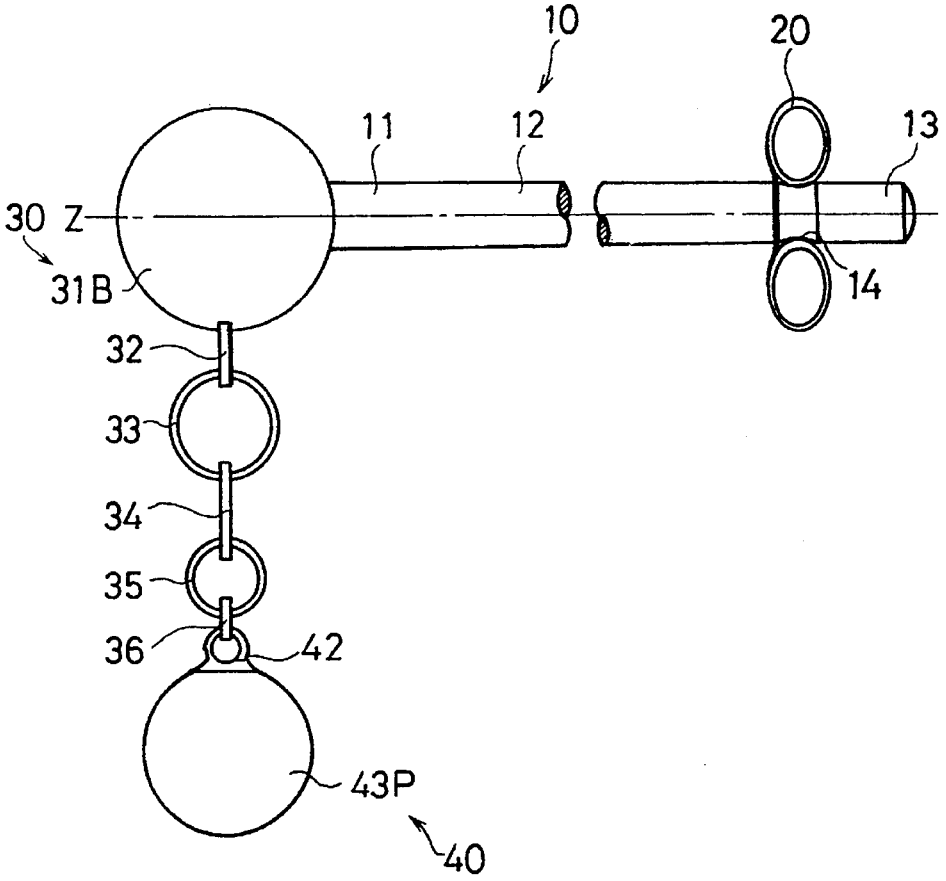
Fig. 9 (Prior Art)
FIG. 9 is a side view of a third conventional pierced earring.

In a second embodiment of the present invention shown in FIG. 4, the post 10 is made of titanium alloy as is in the first embodiment of the present invention shown in FIG. 1. On the other hand, as is clear from FIG. 4, the holder 30 assumes a spherical shape as is in the conventional earring shown in FIG. 9. More particularly, the holder 30 of the second embodiment of the present invention is a reused-one of the post 10 (12) of the conventional earring shown in FIG. 9, which one is obtained by cutting off the conventional post 10 (12) in a manner shown in FIG. 5.

Consequently, in the second embodiment shown in FIG. 4, the insertion hole 50 formed in the solid holder portion 16 of the front-end portion 11 of the post 10 has the same construction as that of the first embodiment of the present invention with the exception of a concave shape (for example, a tapered-bore shape) of the end surface of the solid holder portion 16, which end surface corresponds to the spherical holder 30. Both the adhesive-holding concave portion 52 and the oblique opening 51 of the solid holder portion 16 are so formed as to correspond to the spherical shape of the holder body 31B, which makes it possible to firmly bond the holder body 31B to the post 10.

In the second embodiment of the present invention: it is possible to enjoy the same effect as that of the first embodiment of the present invention; and, it is also possible to firmly bond the holder body 31B to the post 10 even when the holder body 31B assumes a spherical shape. Consequently, the pierced earring assembly of the present invention is considerably improved in adaptability with respect to the shape of the holder body 31B.

THIRD EMBODIMENT OF THE INVENTION

Figure 6:
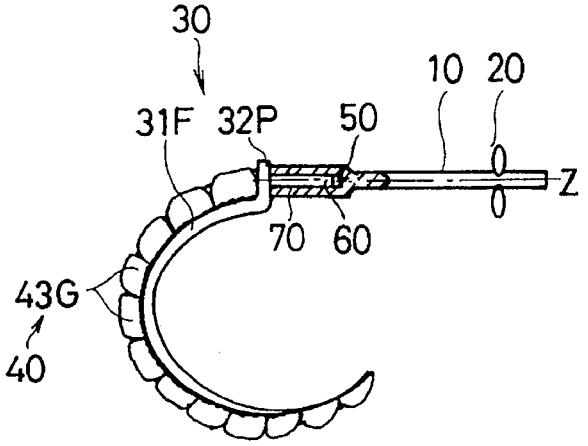
FIG. 6 is a partially-broken side view of a third embodiment of the present invention.
Figure 10:
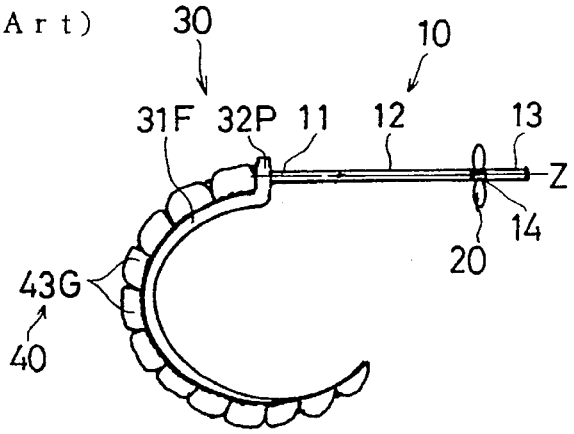
Fig. 10 (Prior Art)
FIG. 10 is a side view of a fourth conventional pierced earring.
Figure 11:
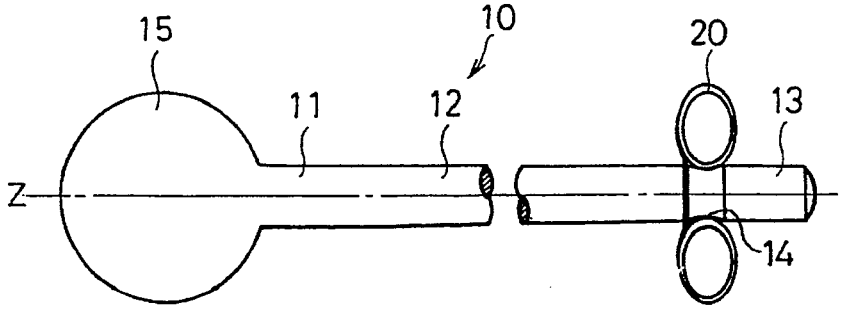
Fig. 11 (Prior Art)
FIG. 11 is a side view of a fifth conventional pierced earring.
Figure 12:
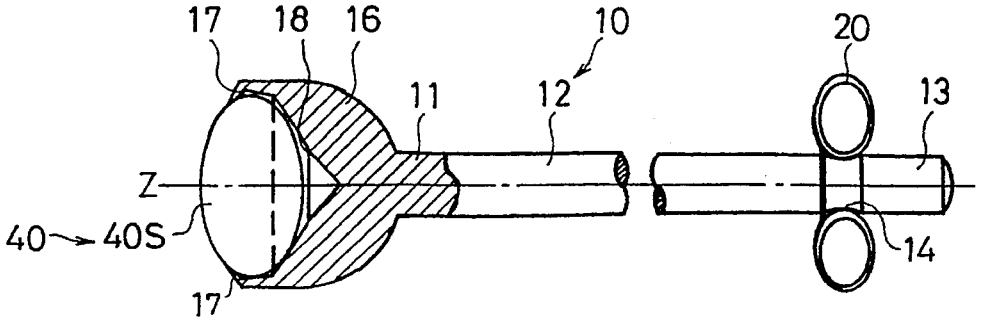
Fig. 12 (Prior Art)
FIG. 12 is a side view of a sixth conventional pierced earring which does not cause a metal allergic reaction.

As shown in FIG. 6, both the holder 30 and the ornament piece 40 are reused-ones of the conventional product shown in FIG. 10. Further, the insertion axle 60 is also a reused-one which is a cut-off part (12) of the post 10 (diameter: 0.6 mm) of the conventional product shown in FIG. 10, as is in each of the first embodiment (shown in FIG. 3) and the second embodiment (shown in FIG. 5).

The post 10 of this third embodiment of the present invention assumes the same configuration as that in the first embodiment of the present invention (shown in FIG. 1). As shown in FIG. 6, the insertion axle 60 of the holder 30 is thin (0.6 mm in diameter). Consequently, in order to increase the adhesive strength of the holder 30, the insertion hole 50 (0.7 mm in diameter) of the second embodiment is doubled in depth in comparison with the first embodiment of the present invention, and, therefore has a depth of 2 mm.

As is clear from the above, in the third embodiment of the present invention: it is possible to realize the same effect as that of the first embodiment of the present invention; and, the adhesive strength is increased by using the insertion axle 60 and the insertion hole 50 both having been doubled in length L or depth, which enables the third embodiment of the present invention to hold a large-sized one of the ornament piece 40 in a safe and a stable manner without fail.

Incidentally, in the above embodiments of the present invention, though the post 10 is made of titanium alloy, it is also possible to use the post 10 made of titanium itself and ceramics.

What is claimed is:

1. A pierced earring assembly, comprising:

a post for insertion through the opening in a pierced earlobe, formed of a material selected from the group consisting of titanium, titanium alloy, and ceramics, said post having a longitudinal axis, a front end portion and a rear end portion, said axis extending in a direction from said front end portion toward said rear end portion, said post having an insertion hole at said front end portion, extending in a direction parallel to said longitudinal axis, and an annular groove at said rear end portion;

a holder having means for supporting an ornament piece, and an insertion axle, fixed to said supporting means and inserted in said insertion hole;

adhesive in said insertion hole fixing said insertion axle to said post; and a stopper detachably mounted in said annular groove.

2. A pierced earring assembly as claimed in claim 1, wherein said front end portion bulges laterally with respect to said axis so that when the assembly is worn on the earlobe, said front end portion blocks contact between said holder and the earlobe.

3. A pierced earring assembly as claimed in claim 2, wherein said front end portion includes a solid holder portion, said solid holder portion having a diameter larger than a diameter of said rear end portion, said insertion hole being formed in said solid holder portion.

4. A pierced earring assembly as claimed in claim 3, wherein said holder has a spherical shape and said solid holder portion has a convex end surface corresponding to the spherical shape of said holder.

5. A pierced earring assembly as claimed in claim 1, wherein said front end portion includes a solid holder portion, said solid holder portion having a diameter throughout that is larger than a diameter of said rear end portion, said insertion hole being formed in said solid holder portion.

6. A pierced earring assembly as claimed in claim 5, wherein said solid holder portion contains a concave adhesive-holding recess communicating with said insertion hole and holding said adhesive therein.

7. A pierced earring assembly as claimed in claim 6, wherein said holder has a spherical shape and said solid holder portion has a convex end surface corresponding to the spherical shape of said holder.

8. A pierced earring assembly as claimed in claim 5, wherein said solid holder portion and said insertion hole have respective first and second lengths in the direction of the longitudinal axis, the second length being less than the first length, so that said insertion hole terminates within said solid holder portion.

9. A pierced earring assembly as claimed in claim 1, wherein said annular groove is a closed annular groove.

* * * * *